US008176643B2

(12) United States Patent
Harada

(10) Patent No.: US 8,176,643 B2
(45) Date of Patent: May 15, 2012

(54) BRAKE SYSTEM OF CHAIN SAW AND CHAIN SAW

(75) Inventor: Atsushi Harada, Kawagoe (JP)

(73) Assignee: Husqvarna Zenoah Co Ltd., Kawagoe-Shi (JP)

( * ) Notice: Subject to any disclaimer, the term of this patent is extended or adjusted under 35 U.S.C. 154(b) by 358 days.

(21) Appl. No.: 12/445,914

(22) PCT Filed: Oct. 19, 2006

(86) PCT No.: PCT/JP2006/320837

§ 371 (c)(1), (2), (4) Date: Apr. 16, 2009

(87) PCT Pub. No.: WO2008/047433

PCT Pub. Date: Apr. 24, 2008

(65) Prior Publication Data

US 2010/0192391 A1 Aug. 5, 2010

(51) Int. Cl.

| | |
|---|---|
| ***B23D 57/02*** | (2006.01) |
| ***A01D 69/10*** | (2006.01) |
| ***F16D 51/00*** | (2006.01) |
| ***F16D 3/06*** | (2006.01) |
| ***B27B 33/02*** | (2006.01) |

(52) U.S. Cl. ..... 30/381; 30/382; 56/11.3; 188/77 W; 188/77 R; 192/129 R; 83/830

(58) Field of Classification Search ..... 30/381, 30/382, 383, 384, 385, 386, 387, 388, 389, 30/390, 391; 56/11.3, 11.6, 17.5; 188/77 W, 188/77 R, 166; 74/89.2; 192/129 R, 130 R, 192/131 R; 83/830, 831, 832, 834, DIG. 1
See application file for complete search history.

(56) References Cited

U.S. PATENT DOCUMENTS

| | | | | |
|---|---|---|---|---|
| 711,825 | A * | 10/1902 | Clarke | 74/89.2 |
| 719,853 | A * | 2/1903 | Osgood | 188/77 R |
| 1,523,665 | A * | 1/1925 | Stahmer | 188/77 R |

(Continued)

FOREIGN PATENT DOCUMENTS

EP 153724 A2 * 9/1985

(Continued)

OTHER PUBLICATIONS

English Language International Search Report dated Jan. 16, 2007 issued in parent Appln. No. PCT/JP2006/320837.

(Continued)

*Primary Examiner* — Boyer D Ashley
*Assistant Examiner* — Samuel A Davies
(74) *Attorney, Agent, or Firm* — Holtz, Holtz, Goodman & Chick, PC

(57) ABSTRACT

According to a chain saw braking system, engagement between a front end portion of a belt and a main body by an engagement member is released at the time of application of an impact. When a front end portion is pulled by the spring force of a compression coil spring, an elongate hole for protrusion is engaged with a protrusion to restrict a rear end portion from being moved in the same direction as the front end portion. Thus, it is possible to strongly tighten a drum by the belt to thereby reliably stop the movement of a chain. With this arrangement, the chain can be prevented from being damaged when a chain saw is accidentally dropped onto the ground due to an impact applied thereto.

5 Claims, 10 Drawing Sheets

U.S. PATENT DOCUMENTS

| | | | | | |
|---|---|---|---|---|---|
| 1,528,841 | A | * | 3/1925 | Myers | 188/71.3 |
| 1,946,758 | A | * | 2/1934 | Powell | 188/166 |
| 2,868,470 | A | * | 1/1959 | Selsted | 242/355.1 |
| 3,844,380 | A | * | 10/1974 | Batson | 184/15.1 |
| 3,923,126 | A | * | 12/1975 | Bidanset | 188/77 W |
| 4,093,184 | A | * | 6/1978 | Wieschel | 254/379 |
| 4,197,640 | A | * | 4/1980 | Murray | 30/382 |
| 4,260,114 | A | * | 4/1981 | Herder | 241/37.5 |
| 4,328,617 | A | * | 5/1982 | Satoh | 30/382 |
| 4,335,514 | A | * | 6/1982 | Overy et al. | 30/382 |
| 4,370,810 | A | * | 2/1983 | Schurr et al. | 30/382 |
| 4,560,040 | A | * | 12/1985 | Morner et al. | 188/77 R |
| 4,573,556 | A | * | 3/1986 | Andreasson | 188/137 |
| 4,586,588 | A | * | 5/1986 | Nagashima et al. | 188/77 R |
| 4,680,862 | A | * | 7/1987 | Wieland et al. | 30/381 |
| 4,683,660 | A | * | 8/1987 | Schurr | 30/382 |
| 4,721,193 | A | * | 1/1988 | Nagashima | 192/17 R |
| 4,757,723 | A | * | 7/1988 | Carson | 74/89.2 |
| 4,760,646 | A | * | 8/1988 | Siegler | 30/382 |
| 4,774,611 | A | * | 9/1988 | Ando | 360/267 |
| 4,787,259 | A | * | 11/1988 | Carson | 74/89.2 |
| 4,891,959 | A | * | 1/1990 | Wood | 68/23.7 |
| 5,042,626 | A | * | 8/1991 | Dohse et al. | 477/192 |
| 5,159,996 | A | * | 11/1992 | LeBlanc | 188/77 R |
| 5,305,729 | A | * | 4/1994 | Chiuminatta et al. | 125/12 |
| 5,456,336 | A | * | 10/1995 | Bopp | 188/17 |
| 5,480,009 | A | * | 1/1996 | Wieland et al. | 188/77 W |
| 5,709,032 | A | * | 1/1998 | Mizutani et al. | 30/382 |
| 5,791,057 | A | * | 8/1998 | Nakamura et al. | 30/381 |
| 5,915,795 | A | * | 6/1999 | Nakamura et al. | 30/382 |
| 5,947,866 | A | * | 9/1999 | Nagashima | 477/200 |
| 5,969,312 | A | * | 10/1999 | Svetlik et al. | 200/61.85 |
| 5,984,054 | A | * | 11/1999 | Martinsson | 188/77 R |
| 6,108,867 | A | * | 8/2000 | Nagashima | 16/110.1 |
| 6,167,973 | B1 | * | 1/2001 | Nagashima | 173/221 |
| 6,493,948 | B2 | * | 12/2002 | Luegger et al. | 30/382 |
| 6,637,117 | B2 | * | 10/2003 | Kobayashi | 30/381 |
| 7,200,941 | B2 | * | 4/2007 | Myers | 30/382 |
| 2006/0169111 | A1 | * | 8/2006 | Kozlowski | 83/13 |

FOREIGN PATENT DOCUMENTS

| | | | |
|---|---|---|---|
| JP | 08-281609 | A | 10/1996 |
| JP | 3263284 | B2 | 3/1997 |
| JP | 2001-047403 | A | 2/2001 |

OTHER PUBLICATIONS

English language International Preliminary Report on Patentability and Written Opinion of the International Searching Authority dated Apr. 22, 2009 (5 pages), issued in counterpart International Application Serial No. PCT/JP2006/320837.

* cited by examiner

BRAKE SYSTEM OF CHAIN SAW AND CHAIN SAW

This application is a U.S. National Phase Application under 35 USC 371 of International Application PCT/JP2006/320837 filed Oct. 19, 2006.

TECHNICAL FIELD

The present invention relates to a braking system for stopping a chain of a chain saw and a chain saw provided with the braking system.

BACKGROUND ART

A chain saw including an endless chain (saw chain) has been used for cutting down or pruning trees, bamboos, or the like. The endless chain is rotated by a lever when such a chain saw is used.

Such a chain saw incorporates a braking system. When, e.g., the chain saw is accidentally dropped onto the ground or beaten strongly against a tree and, thereby, an impact is applied thereto, the braking system is activated to stop the drive of the chain to prevent the chain from being damaged. The braking system includes, e.g., a drum coupled to the rotary shaft of a sprocket with which the chain is engaged, a belt wound around the drum, and a spring disposed on one end of the belt. The belt is pulled by a biasing force of the spring to tighten the rotating drum to thereby stop the rotation thereof.

Such a chain saw has a driving source such as an engine or electric motor and a centrifugal clutch interposed between the driving source and chain. When an operating lever is operated to make the driving source rotate at high speed, the centrifugal clutch is brought into an engagement state, whereby a driving force is transmitted to the chain. On the other hand, when the operating lever is returned to its initial position to decrease the rotation speed of the driving source, the centrifugal clutch is brought into a disengagement state.

However, in the above arrangement, even when the operating lever is returned to its initial position to bring the centrifugal clutch into a disengagement state, the chain is not stopped immediately by virtue of rotational inertia. In order to cope with such a disadvantage, there is proposed an electric-motor driven chain saw having a mechanism that pulls the other end (opposite side to the side on which the spring is disposed) of the belt wound around the drum of the above-mentioned braking system (see, e.g., Patent Document 1).

Patent Document 1: Japanese Patent No. 3263284 (columns [0024] to [0027], FIG. 3)

DISCLOSURE OF THE INVENTION

Problems to be Solved by the Invention

However, in the case where both ends of the belt wound around the drum are pulled respectively, i.e., two separate braking mechanisms exist, as disclosed in Patent Document 1, when one side of the belt is pulled, the other side thereof may follow the movement of the one side, which may cause the belt to be moved in such a direction that it looses. Therefore, it is required to perform complicated adjustment procedures in order to obtain desired braking performance.

An object of the invention is therefore to provide a chain saw braking system capable of reliably stopping a chain when the operation state is switched from a driving state to non-driving state, and a chain saw provided with the braking system.

Means for Solving the Problems

A chain saw braking system according to an aspect of the invention, which is used in a chain saw having a main body incorporating an engine and a chain provided with saw blades and rotating the chain around a guide member provided in the main body by engine drive to stop the movement of the chain, includes: a drum provided on the rotary shaft of a sprocket for transferring a driving force of the engine to the chain, the drum being rotated together with the sprocket; a belt that is wound around the drum and has first and second ends which are drawn in opposite directions to each other; first and second biasing units that bias the first and second ends of the belt in the opposite directions to tighten the drum; an engagement member that engages the belt with the main body to counteract the biasing force of the first biasing unit; and a restricting unit that restricts, within a given area, the second end of the belt from being moved following the first end of the belt when the first end is moved by the biasing force of the first biasing unit.

According to the aspect of the invention, when the belt is pulled by the biasing force of the first biasing unit, the restricting unit restricts, within a given area, the second end of the belt from being moved in the same direction as the first end. Thus, it is possible to strongly tighten the drum by the belt, thereby reliably stopping the chain upon stop of the rotation of the drum and sprocket.

Specifically, when, for example, cutting-down of trees or the like is made at an end of a guide member or when the end is hit against an obstacle and thereby the chain saw is kicked back upward, an impact is applied to the chain saw. Accordingly, a large external force acts on an engagement member to release an engagement of a belt by the engagement member, causing one end of the belt to be pulled. At this time, the drum is strongly tightened by the belt to thereby reliably and quickly stop the chain. This prevents the chain from being damaged at the time of application of an impact.

Further, according to the aspect of the invention, when a throttle lever is released, an end portion of the belt is pulled by the biasing force of the second biasing unit. This allows the drum to be tightened by the belt, thereby stopping the chain upon stop of the rotation of the drum and sprocket. In other words, it is possible to prevent the chain from being rotated by an inertial force after the release of the throttle lever and thereby to stop the rotation of the chain for a short time.

In the chain saw braking system according to the aspect of the invention, the belt may have an attachment portion to which the second biasing unit is attached, the attachment portion may have an elongate hole extending in a longitudinal direction of the belt, and the restricting unit may be a protrusion to be inserted through the elongate hole.

With this arrangement, simply by engaging the elongate hole with the protrusion, it is possible to restrict the movement of the belt. This simplifies the structure of the chain saw. Further, the protrusion is fixed to the main body or casing, so that it is possible to restrict the movement of the belt not only in the longitudinal direction of the elongate hole but also in the direction crossing the longitudinal direction of the elongate hole. Thus, the belt can be prevented from being displaced in the width direction of the drum on the outer circumference thereof, thereby stably stopping the chain.

In the chain saw braking system according to the aspect of the invention, the second biasing unit may be a coil spring.

One end of the coil spring may be attached to the second end of the belt and the other end of the coil spring may be attached to an internal thread member furnished with internal threads. Further, an external thread member which is fixed to the main body and furnished with external threads may be threadedly engaged with the internal thread member, and a rotation of the external thread member may allow the internal thread member to be reciprocatively moved in a biasing direction of the coil spring.

According to the aspect of the invention, the rotation of the external thread member causes the internal thread member to go forward and backward to change extension stroke of the coil spring, i.e., biasing force thereof, thereby changing the tightening force of the belt on the drum. This allows control of the length of the braking time required for stopping the chain. By appropriately controlling the length of the time for braking the chain, it is possible to lop the branches of trees with a remaining power, for example. Thus, usability can be increased by controlling the length of the time for stopping the chain depending on the kinds of trees to be cut down or usability of the chain saw.

In the chain saw braking system according to the aspect of the invention, the main body may have a throttle lever for controlling an output of the engine and a stopper engaging with an edge surface of the second end of the belt while the throttle lever is pivoted in a direction against the biasing force of the second biasing unit.

According to this arrangement, by pushing down the stopper in a state where the throttle lever is pivoted to be engaged with the edge surface of the belt, the movement of the belt by the second biasing force can be restricted. Thus, when the throttle lever is returned to its original position, a braking mechanism by the second biasing force can be prevented from being activated. Due to the use of the stopper, the braking mechanism by the second biasing force can be used depending on the work to be done, thereby increasing usability.

A chain saw according to another aspect of the invention includes the abovementioned chainsaw braking system.

Since the braking system is provided as described above, the same advantages can be obtained as described above.

FIRST EMBODIMENT

The first embodiment of the invention will be described below with reference to the attached drawings.

Figure 1:
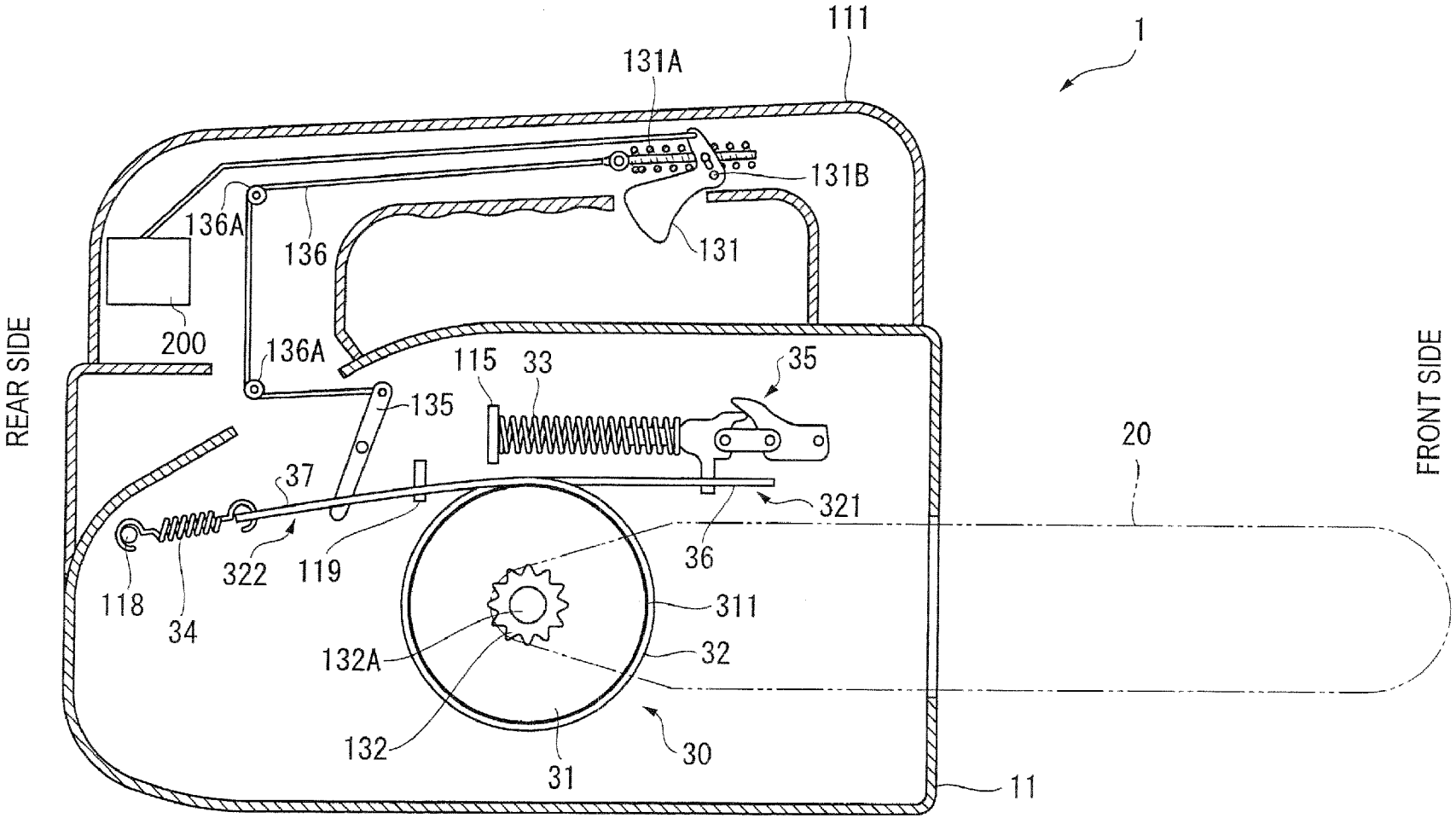
FIG. 1 schematically shows a chain saw according to a first embodiment of the invention.

FIG. 1 schematically shows a chain saw 1 according to the first embodiment of the invention.

The chain saw 1 is configured to drive a chain 20 wound around a guide member (not shown) protruded to the front side from a main body 11 covered with a synthetic resin case by means of an engine (not shown). An operator grasps a bar-shaped handle 111 extending in a front-and-rear direction for use. The handle 111 is grasped by one hand of the operator. Although not shown, another handle grasped by the other hand is also provided in the chain saw 1.

A throttle lever 131 for controlling the amount of intake air into the engine is provided together with a spring 131A in the grip portion of the handle 111. When the operator grasps the handle 111, the throttle lever 131 pivots about a throttle axis 131B, and when the operator loosens his or her grasp upon the handle 111, the throttle lever 131 is biased by the spring 131A to be returned to an original position. A carburetor 200 is connected to the throttle lever 131.

Further, on the front side of the handle 111, a hand guard (not shown) for protecting the hand of the operator from the rotating chain 20 is provided.

The engine is housed inside the main body 11, and a sprocket 132 is coupled to the output shaft of the engine.

The chain 20, which is an endless saw chain provided with saw blades, is wound around the guide member and the sprocket 132 and is rotated by an engine driving force which is transmitted to the sprocket 132.

A drum 31 incorporating a centrifugal clutch is coupled to a rotary shaft 132A of the sprocket 132 and is thus rotated together with the sprocket 132.

A metal belt 32 is wound around an outer circumference 311 of the drum 31. The metal belt 32 has a front end portion 321 and a rear end portion 322, which are drawn in the opposite directions to each other. When the drum 31 is tightened by the belt 32, rotations of the drum 31 and sprocket 132 are stopped, thereby stopping a drive of the chain 20. A braking system 30 includes the belt 32 and drum 31.

Figure 2:
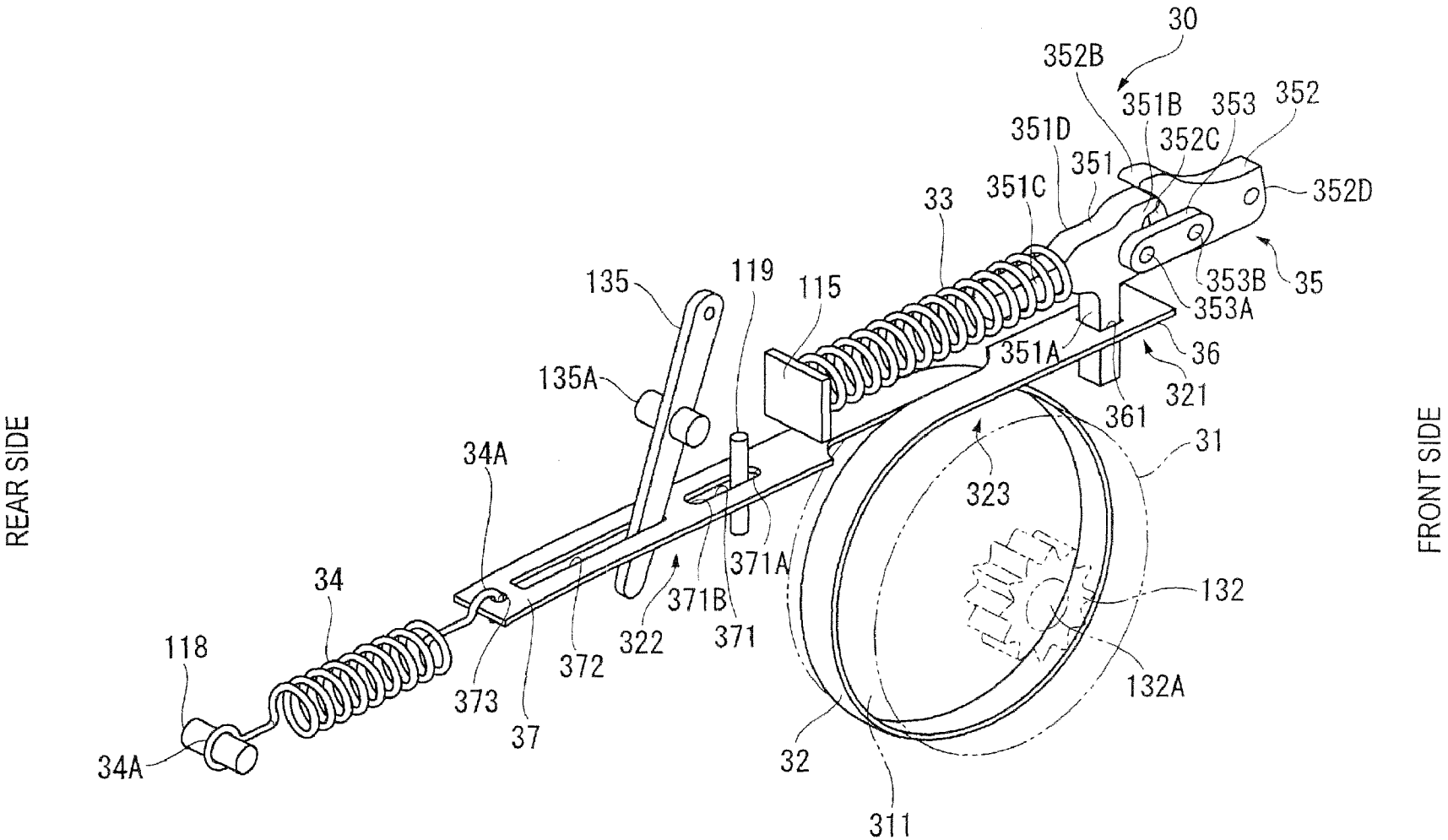
FIG. 2 is a perspective view showing a braking system of the chain saw according to the first embodiment.

FIG. 2 is a perspective view showing the braking system 30.

In addition to the drum 31 (denoted by double-dot-and-dash lines of FIG. 2) and belt 32, the braking system 30 includes a powerful compression coil spring 33 which is a first biasing unit for biasing the front and rear end portions 321 and 322 of the belt 32 in the opposite directions to each other, a tension coil spring 34 which is a second biasing unit, and an engagement member 35 for engaging the front end portion 321 of the belt 32 with the main body 11 (FIG. 1).

The belt 32 has a width smaller than that of the outer circumference 311 of the drum 31. The front and rear end portions 321 and 322 of the belt 32 cross each other at a crossover portion 323 on the outer circumference 311 of the drum 31.

The width of the belt 32 is increased at the front end portion 321 compared to the width of the belt 32 at the crossover portion 323. This widened portion serves as a front attachment 36 in which a hole 361 through which an engagement member 35 is inserted is formed.

A chain (kickback) braking mechanism, which is activated when an impact is applied by a kickback or the like, includes the front attachment 36, the engagement member 35, and the compression coil spring 33.

The engagement member 35 includes a first member 351 positioned on a side close to the front attachment 36 and a second member 352 connected to the first member 351 through a link 353.

The first member 351 has a pin 351A which is inserted through the hole 361, a protrusion 351B which protrudes upward, and a bar-shaped portion 351C which is inserted into the compression coil spring 33. The compression coil spring 33 is disposed, in a compressed state, between a spring stopper 115 formed as a part of the main body 11 and a base end of the bar-shaped portion 351C.

The second member 352 has a protrusion 352B which faces the protrusion 351B of the first member 351 and a slope portion 352C which is gradually away from the first member 351 as it extends downward from the protrusion 352B. An end portion 352D on the opposite side of the protrusion 352B and slope portion 352C is pivotably fitted to the main body 11.

The link 353 has two pivots 353A and 353B at its both ends. The first and second members 351 and 352 are connected to each other by the pivots 353A and 353B so as to be pivoted thereabout.

Although the first member 351 is biased by a spring force of the compression coil spring 33 toward the second member 352, the first member 351 is away from the second member 352 due to interposition of the link 353 between the first and second members 351 and 352. At this time, as shown in FIG. 2, the first and second members 351 and 352 are arranged in the direction opposite to each other with the pivots 353A and 353B of the link 353 arranged in juxtaposition.

The width of the belt 32 is increased at the rear end portion 322 compared to the width of the belt 32 at crossover portion 323, as in the case of the front end portion 321. This widened portion serves as a rear attachment 37. A throttle braking mechanism, which is activated when the throttle lever 131 is returned to the original position, includes the rear attachment 37 and tension coil spring 34.

The rear attachment 37, which extends in the longitudinal direction of the belt 32, is formed relatively long. The rear attachment 37 has an elongate hole 371 for protrusion and an elongate hole 372 for lever, which are arranged in juxtaposition in the longitudinal direction. The tension coil spring 34 is attached to the end of the rear attachment 37.

The tension coil spring 34 has hooks 34A at both ends, one of which is hooked to a hole 373 formed in the rear attachment 37 and the other of which is engaged with a spring stopper 118 provided in the main body 11.

A protrusion 119 serving as a restricting unit fixed to the main body 11 is inserted through the elongate hole 371 for protrusion.

An internal lever 135 working with the throttle lever 131 is inserted through the elongate hole 372 for lever. As shown in FIG. 1, the internal lever 135 is connected to the throttle lever 131 by a wire 136 guided by guide rollers 136A inside the handle 111, whereby a movement of the throttle lever 131 is transmitted to the belt 32 through the rear attachment 37. More specifically, the internal lever 135 is provided to the main body 11 so as to be pivoted about a pivot 135A and is pivoted via the wire 136 when the throttle lever 131 is pivoted in an ON direction. As a result, the rear attachment 37 is moved in the direction against the spring force of the tension coil spring 34.

Operation of the braking system 30 as described above will be described with reference to FIGS. 3 to 7.

Figure 3:
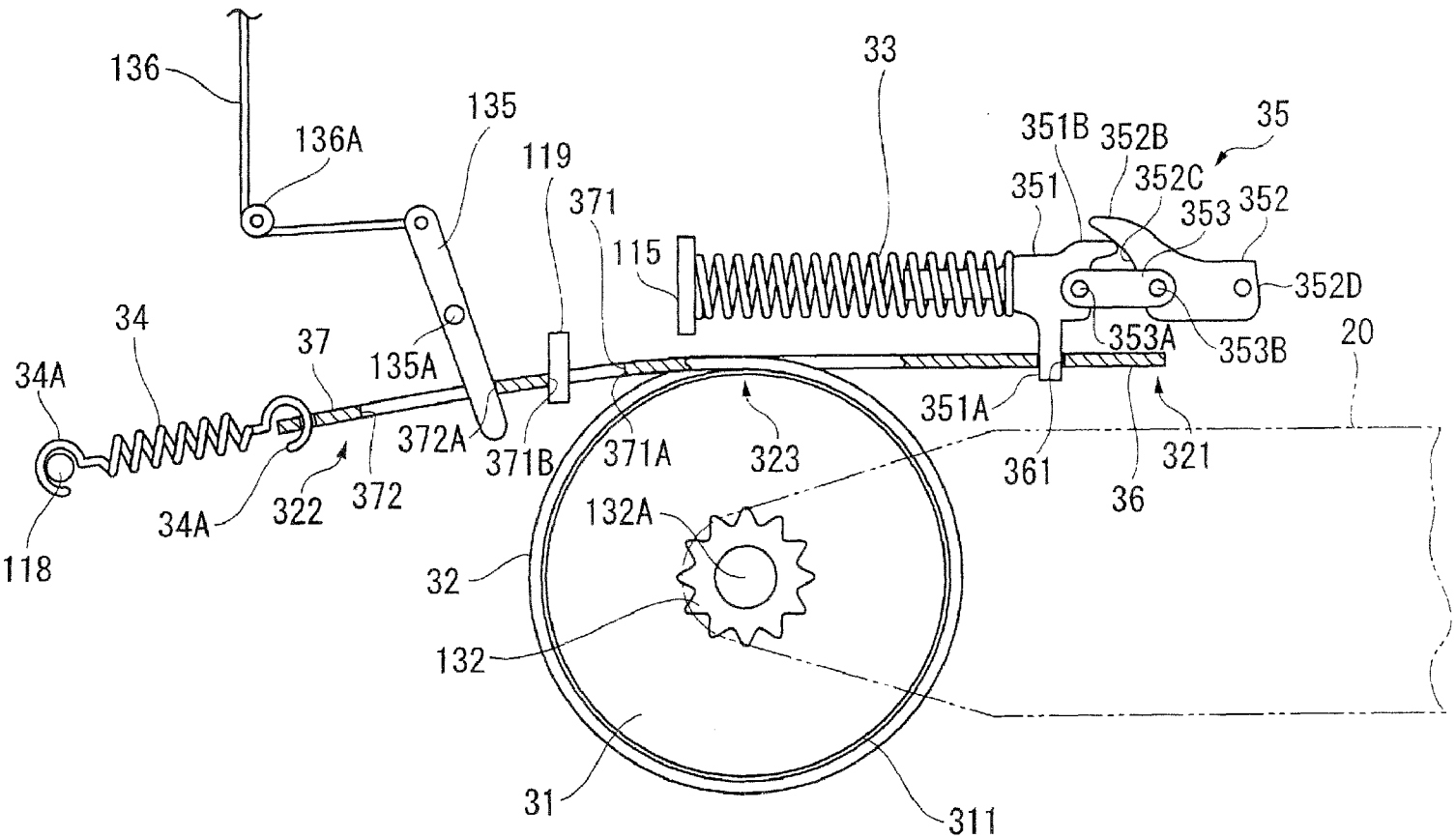
FIG. 3 is a view for explaining operation of the first embodiment, which shows a state where a throttle lever is pivoted to drive a chain.
Figure 4:
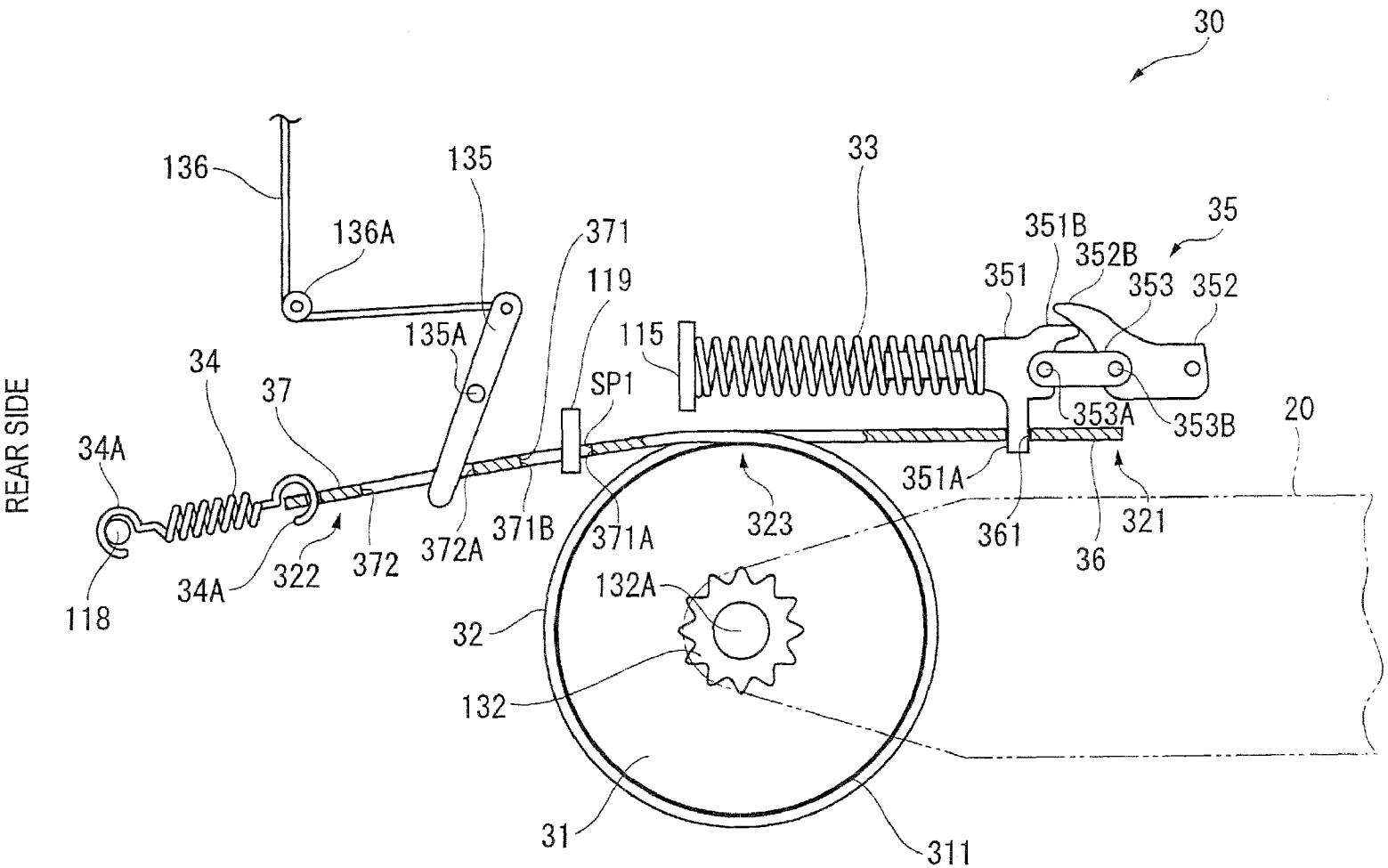
FIG. 4 is a view showing a state where a throttle braking system is activated in the state of FIG. 3.

FIGS. 3 and 4 show a driving state and a driving stop state in normal use of the chain saw 1, respectively.

FIG. 3 shows a state where the chain 20 is driven by an ON operation of the throttle lever 131 (FIG. 1). At this time, the internal lever 135 is pivoted in conjunction with the operation of the throttle lever 131 to press an end portion 372A of the elongate hole 372 for lever on the rear attachment 37, whereby the rear attachment 37 is moved in the direction against the spring force of the tension coil spring 34. Due to the pivoting of the internal lever 135, the rear end portion 322 of the belt 32 is moved toward the drum 31 to loosen the belt 32 on the outer circumference 311 of the drum 31, so that the rotation of the drum 31 is not restricted by the belt 32, and the throttle braking mechanism of the braking system 30 is in a released state.

When the throttle lever 131 is returned to the original position at this time, the centrifugal clutch is disengaged due to a reduction in the number of rotations of the engine. Accordingly, transmission of the engine driving force to the sprocket 132 is stopped and, at the same time, the rear end portion 322 of the belt 32 is pulled to the rear side by the spring force of the tension coil spring 34 as shown in FIG. 4. Consequently, the drum 31 is tightened by the belt 32. At this time, a space SP1 exists between the protrusion 119 and an end portion 371A of the elongated hole 371 for protrusion, and the rear attachment 37 is retained by the spring force of the tension coil spring 34. With the above braking operation of the throttle braking mechanism in the braking system 30, the rotation of the drum 31 as well as the drive of the chain 20 can be stopped quickly.

Figure 5:
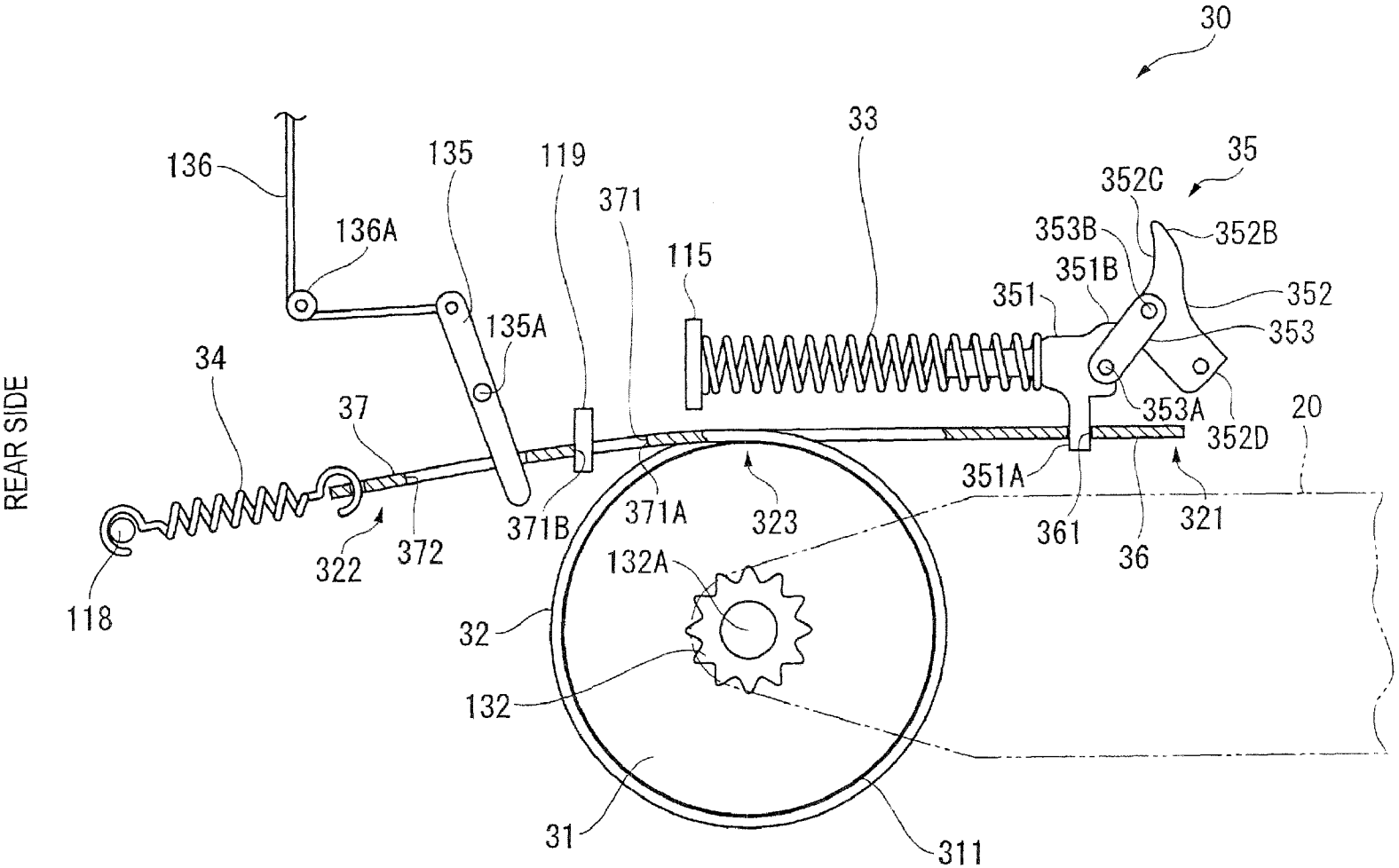
FIG. 5 is a view for explaining a braking operation performed in a chain (kickback) braking system when some impact is applied to the chain saw according to the first embodiment.
Figure 6:
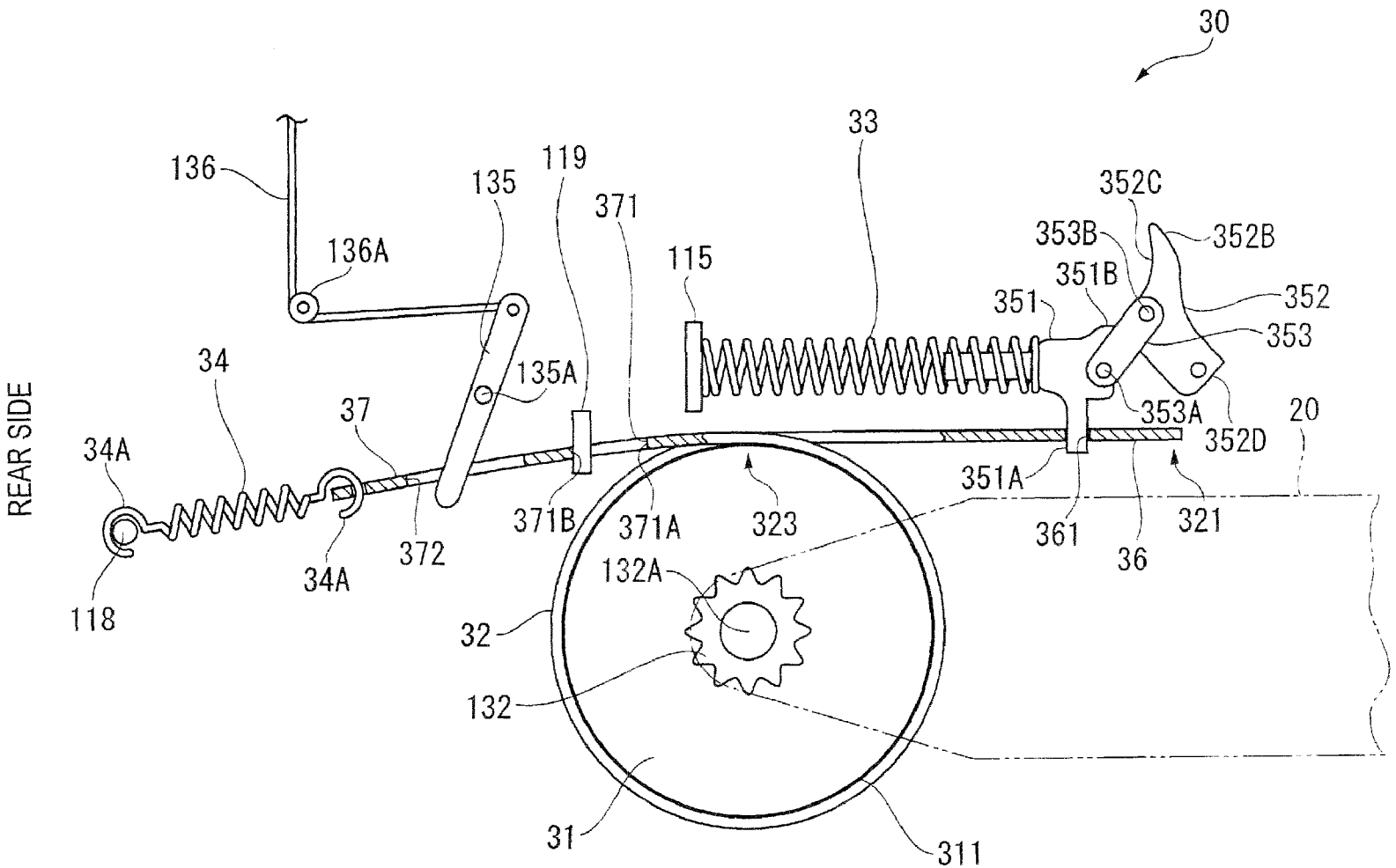
FIG. 6 shows a state where the throttle lever is returned to an original position in the state of FIG. 5.

FIGS. 5 and 6 show the braking operation of the braking system 30 when some impact is applied to the chain saw 1.

FIG. 5 shows a state where some impact is applied to the chain saw 1 while the operator grasps the throttle lever 131. The external impact causes the second member 352 of the engagement member 35 to be pivoted upward, so that the link 353 is slanted. Correspondingly, the first and second members 351 and 352 move closer to each other and, at the same time, the compression coil spring 33 is slightly restored. The restoration of the compression coil spring 33 causes the front end portion 321 of the belt 32 to be pulled toward the frond side, and the rear end portion 322 of the belt 32 follows the movement of the front end portion 321. At this time, however, the end portion 371B of the elongate hole 371 for protrusion is engaged with the protrusion 119 to restrict the movement of the rear end portion 322, so that the drum 31 is strongly tightened by the belt 32, so that the chain 20 is reliably and quickly stopped.

FIG. 6 shows a state where the operator releases the throttle lever 131 in the state of FIG. 5. At this time, the internal lever 135 is pivoted along the elongate hole 372 for lever and restored to the original position by the biasing movements of the tension coil spring 34, drum 31, and carburetor 200.

In any of the states shown in FIGS. 3 and 4 (normal braking operation performed by the throttle braking mechanism of the braking system 30), and FIGS. 5 and 6 (braking operation performed by the chain braking mechanism at the time of application of an impact), the belt 32 is quickly moved by the spring force of the compression coil spring 33 or tension coil spring 34. However, the protrusion 119 is inserted through the elongate hole 371 for protrusion of the rear attachment 37, so that the belt 32 is moved only in the longitudinal direction of the elongate hole 371 for protrusion and is not displaced in the width direction on the outer circumference 311 of the drum 3. Consequently, the chain 20 is stably and reliably stopped.

According to this embodiment, the following advantages can be obtained.

(1) In the braking system 30 of the chain saw 1, when the chain braking mechanism is activated at the time of application of an impact, and the front end portion 321 of the belt 32 is pulled by the spring force of the compression coil spring 33, the rear end portion 322 follows the movement of the front end portion 321 because the elongate hole 371 for protrusion is engaged with the protrusion 119 on the rear end portion 322. Accordingly, the rear end portion 322 is restricted from being moved in the same direction as the front end portion 321. Thus, even with the arrangement in which the throttle braking mechanism is provided to have the tension coil spring 34, it is possible to strongly tighten the drum 31 by the belt 32. This arrangement allows the chain braking mechanism to reliably function when an impact is applied to the chain saw 1, thereby quickly stopping the movement of the chain 20.

(2) Simply by engaging the elongate hole 371 for protrusion of the rear attachment portion 37 with the protrusion 119, it is possible to restrict the movement of the rear end portion 322 of the belt 32 at the end portion 371B of the elongate hole 371 for protrusion. Further, since the protrusion 119 is fixed to the main body or casing, it is possible to restrict the movement of the belt 32 in the direction crossing the longitudinal direction of the elongate hole 371 for protrusion. Thus, the belt 32 can be prevented from being displaced in the width direction of the drum 31 on the outer circumference 311 thereof, thereby stably stopping the chain 20.

SECOND EMBODIMENT

The second embodiment of the invention will be described with reference to FIGS. 7 to 9.

A braking system 40 according to the second embodiment mainly differs from the braking system 30 according to the first embodiment in that the spring force of the tension coil spring 34 biasing the rear end portion 322 of the belt 32 can be controlled and that a stopper 375 for engaging with the rear end portion 322 of the belt 32 is additionally provided. Further, the chain saw according to the second embodiment does not include the internal lever 135 as described in the first embodiment. Accordingly, an elongate hole for insertion of the internal lever 135 is not formed on the rear attachment 47 included in the rear end portion 322 of the belt 32, and the rear attachment 47 and throttle lever 137 are directly connected to each other by the wire 136.

Figure 7:
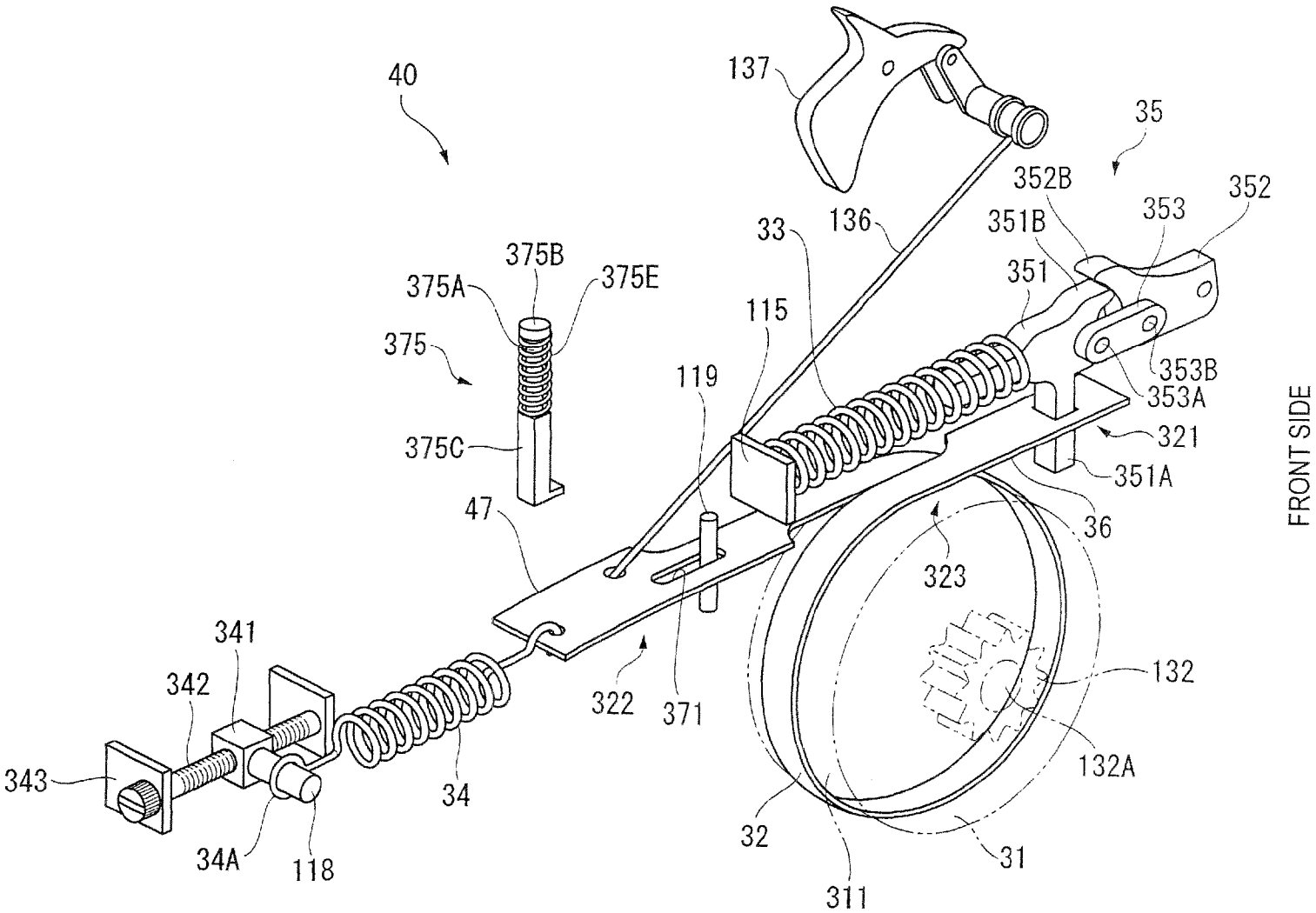
FIG. 7 is a perspective view showing a braking system of a chain saw according to a second embodiment of the invention.

In the braking system 40 shown in FIG. 7, the spring stopper 118 of the tension coil spring 34 is protruded from a piece member 341 which is slidably accommodated in a bracket (not shown). An internal thread penetrates the piece member 341 along the expansion/contraction direction of the tension coil spring 34. An external thread member 342 furnished with external threads is threadedly engaged with the internal threads. Accordingly, the rotation of the external thread member 342 causes the piece member 341 and spring stopper 118 to be advanced and retracted. The spring force of the tension coil spring 34 can be adjusted with the movement of the spring stopper 118. More specifically, when the external thread member 342 is rotated to retract the piece member 341, the tension coil spring 34 is expanded to increase the spring force thereof. On the contrary, when the external thread member 342 is rotated to advance the piece member 341, the tension coil spring 34 is contracted to decrease the spring force thereof.

The shape of the bracket through which the external thread member 342 is inserted is not particularly limited as far as the bracket has an engagement piece 343 with which the head portion of the external thread member 342 is engaged and the piece member is not rotated together with the external thread member 342.

In the throttle braking mechanism, as described above, the belt 32 is pulled by the spring force of the tension coil spring 34 and the drum 31 is tightened by means of the belt 32, thereby braking the drive of the chain 20. Thus, by controlling the spring force of the tension coil spring 34 by adjusting the screwing degree of the external thread member 342, it is possible to control the force tightening the drum 31 by the belt 32.

That is, when the external thread member 342 is well tightened to increase the spring force of the tension coil spring 34, a pulling force acting on the belt 32 is increased when the throttle lever 137 is returned to the original position thereof, which increases the force for tightening the drum 31 by the belt 32. Therefore, it is possible to significantly reduce the time required from when the throttle lever 137 is returned to the original position thereof to start the braking operation of the braking system 40 until when the chain 20 is stopped.

On the other hand, when the external thread member 342 is loosened to reduce the spring force of the tension coil spring 34, a pulling force acting on the belt 32 is decreased when the throttle lever 137 is returned to the original position thereof, which decreases the force for tightening the drum 31 by the belt 32. As a result, it takes a slightly longer time to stop the chain 20. The length of the time for braking the chain 20 can appropriately be controlled depending on the kinds of trees to be cut down or usability of the chain saw 1. For example, when the braking time is set longer, it is possible to lop the branches of trees with a remaining power.

Figure 8:
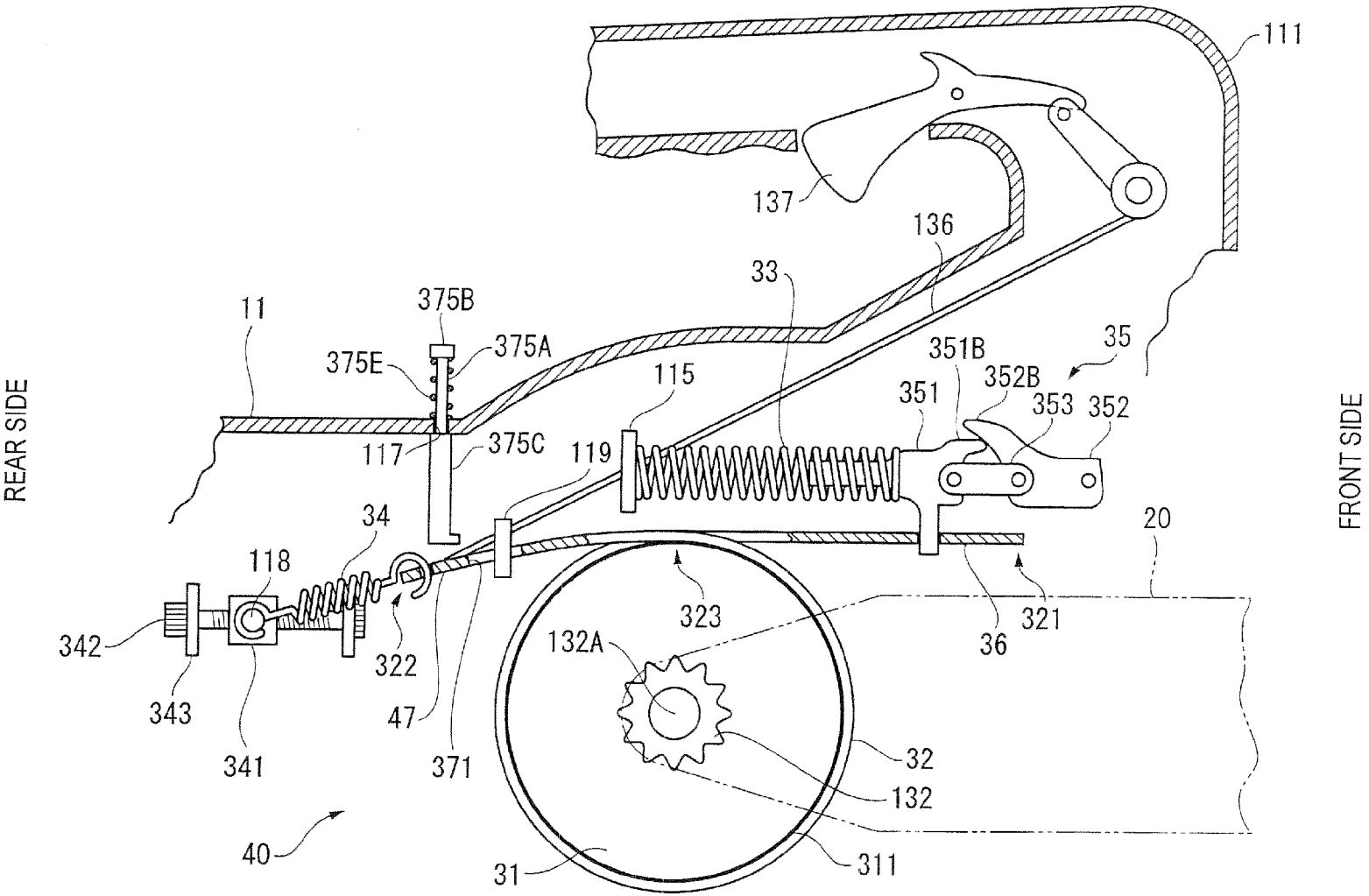
FIG. 8 shows a state where a stopper does not function in the braking system according to the second embodiment.
Figure 9:
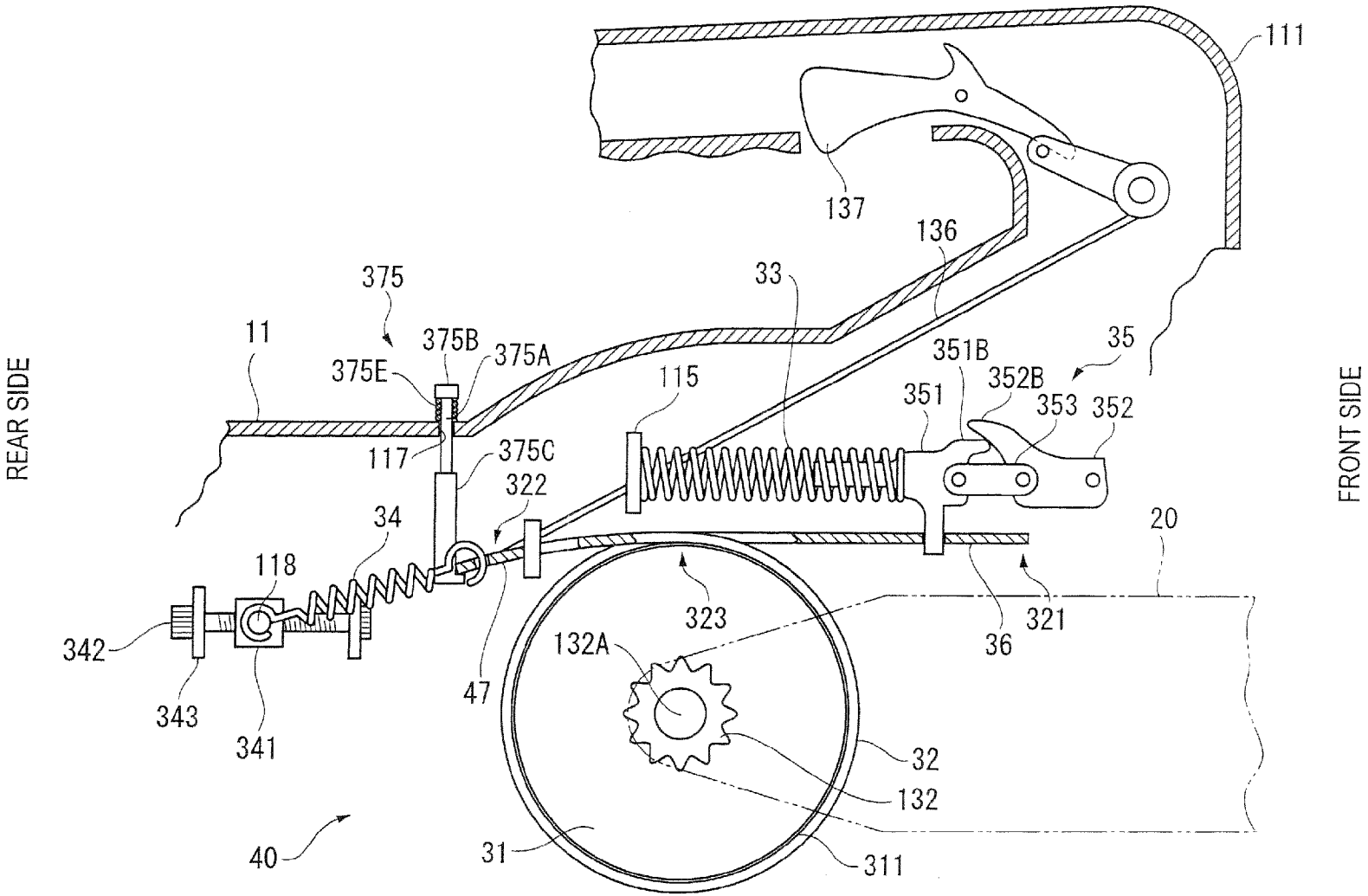
FIG. 9 shows a state where the stopper functions in the braking system according to the second embodiment.

The stopper 375 which faces the rear attachment 47 is provided in the main body 11 (FIG. 8). The stopper 375 is engaged with the rear end portion 322 of the belt 32 to thereby restrict the actuation of the throttle braking mechanism.

FIG. 8 is a side view showing the braking system 40. The stopper 375 is a bar-shaped member which is inserted through an opening 117 of the main body 11 so as to be protruded relative to the rear attachment 47. The stopper 375 has a stepped pin portion 375A which is inserted through the opening 117, an engagement portion 375C which is engaged with the edge surface of the rear attachment 47 when the pin portion 375A is pushed down, and a spring 375E which is disposed between a head 375B of the stepped pin portion 375A and main body 11.

The stopper 375 does not function in the state shown in FIG. 8. FIG. 9 shows a state where the stopper 375 functions. The stopper 375 can be pushed inside the main body 11 only after the throttle lever 137 is pivoted to move the rear attachment 47 toward the drum 31 via the wire 136 as shown in FIG. 9. At this time, the head 375B of the stopper 375 is pushed down and thereby the engagement portion 375C is moved toward the edge surface of the rear attachment 47. As a result, the engagement portion 375C is engaged with the edge surface of the rear attachment 47 by the spring force of the spring 375E. This engagement restricts the movement of the rear end portion 322 of the belt 32. Thus, when the throttle lever 137 is returned to the original position thereof, the wire 136 goes slack and the belt 32 is kept loose on the outer circumference 311 of the drum 31. In other words, simply by pushing down the stopper 375, the throttle braking mechanism is not activated.

When the stopper 375 is pulled out of the main body 11, the engagement portion 375C is disengaged from the edge surface of the rear attachment 47. Then, the belt 32 is moved by the spring force of the tension coil spring 34 while the stopper 375 is pulled up by the spring force of the spring 375E. In this state, as in the case of the first embodiment, the throttle braking mechanism in the braking system 40 can be activated in conjunction with the operation of the throttle lever 137. The operator may appropriately use the function implemented by the stopper 375 depending on the work to be done.

According to the present embodiment described above, the following advantages can be obtained in addition to the abovementioned advantages (1) and (2).

(3) In the braking system 40, the attachment structure of the tension coil spring 34 includes the piece member 341 and external thread member 342, and the spring force of the tension coil spring 34 is controlled by adjusting the screwing degree of the external thread member 342. Accordingly, the force for tightening the drum 31 by the belt 32 can be controlled to be variable, which allows control of the length of the braking time required for stopping the chain 20. Thus, it is possible to set any length of the braking time required for stopping the chain 20 depending on the usage or usability, while enabling the chain 20 to be reliably stopped as described above.

(4) Further, the stopper 375, which is provided for restricting the movement of the belt 32, is pushed down to be engaged with the edge surface of the rear attachment 47 of the belt 32. Accordingly, the throttle braking mechanism can be prevented from being activated even when the throttle lever 137 is returned to the original position thereof. Due to the use of the stopper 375, the throttle braking mechanism can be switchably operated depending on the work to be done, thereby increasing usability.

THIRD EMBODIMENT

The third embodiment of the invention will next be described.

In the third embodiment, an electrical switch relating to engine starting is provided on the stopper 375 of the second embodiment.

Figure 10:
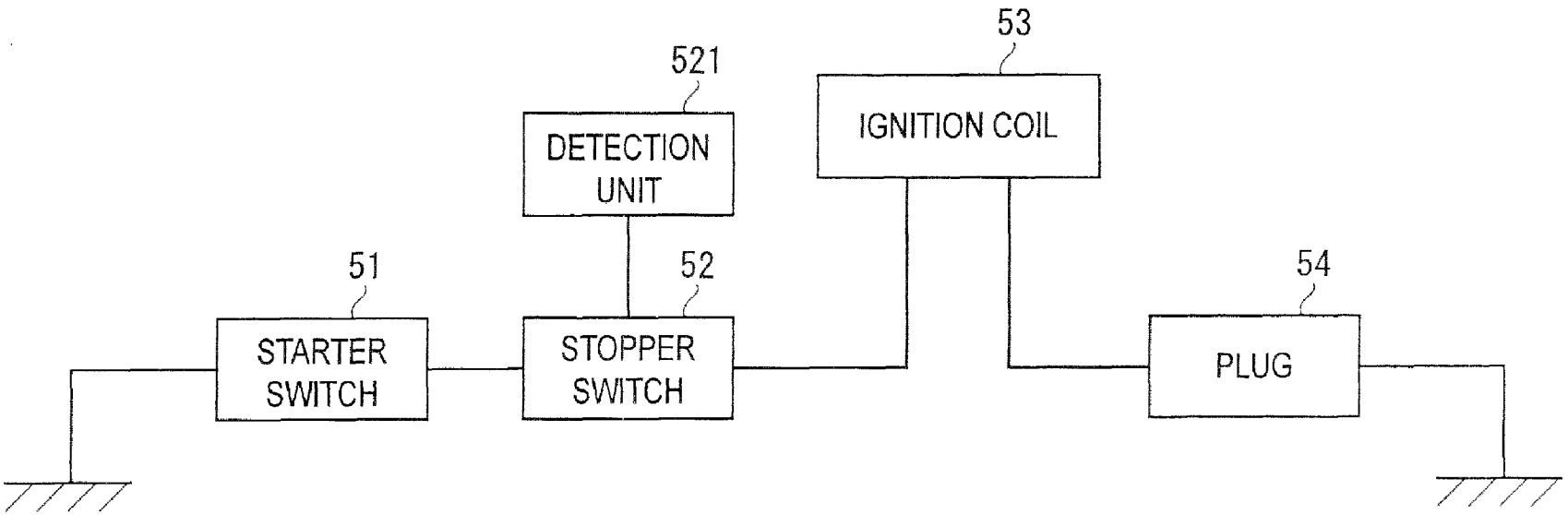
FIG. 10 is a block diagram showing an electrical switch provided in a stopper according to a third embodiment.

FIG. 10 is a block diagram showing an electrical system 50 for starting-up the engine. When a starter switch 51 is turned on, a current is applied between an ignition coil 53 such as a CDI (Capacitor Discharge Ignition) magnet and a plug 54 provided that a stopper switch 52 provided on the stopper 375 is in an ON state.

The stopper switch 52 serves as an electrical switch between the pin portion 375A (FIG. 8) of the stopper 375 and a junction (not shown) provided in the main body 11. In a state where the stopper 375 is pulled up, the pin portion 375A and main body 11 are brought into contact with each other to turn on the stopper switch 52, whereby a current can be applied to the plug 54.

On the other hand, in a state where the stopper 375 is pushed down, the pin portion 375A is away from the main body 11 to turn off the stopper switch 52. Accordingly, a current is not applied to the plug 54 even when the starter switch 51 is turned on. As a result, the engine is not started-up in this state.

Thus, in order to start-up the engine, it is necessary to pull up the stopper 375 before the operation of the starter switch 51. In other words, in a state where the stopper 375 is pushed down, the rear attachment 47 is engaged at the engagement portion 375C and the throttle braking mechanism of the braking system 40 is prevented from being activated. In this state, the engine cannot be started-up.

The stopper switch 52 is provided with a detection unit 521 for detecting whether the engine is in a driving state or non-driving state. Only when the detection unit 521 detects the non-driving state of the engine, the stopper switch 52 is turned off upon push-down of the stopper 375. Thus, even when the stopper 375 is pushed down while the engine is being driven, the stopper switch 52 is not tuned off. At this time, while the throttle braking mechanism is prevented from being activated, the engine in a driving state is not stopped.

According to the present embodiment described above, the following advantages can be obtained in addition to the abovementioned advantages (1) and (4).

(5) The stopper switch 52 is added to the stopper 375, and the engine is prevented from being started-up in a state where the throttle braking mechanism is released after push-down of the stopper 375. Thus, it is possible to prevent the engine from being started-up in a state where the throttle braking mechanism is invalid unless the stopper 375 is pulled back. Thus, a user-friendly chain saw 1 can be achieved.

It should be noted that, although the best structure, method and the like for carrying out the invention have been described in the above description, the invention is not limited to the above description. Although the invention is illustrated and described mainly with reference to a specified embodiment, those skilled in the art may modify the embodiments in shapes, amounts, and other specific arrangements to make a variety of modifications without departing from the spirit and scope of the invention.

The above description limiting shapes, amounts and the like is exemplary description for facilitating understanding of the invention and does not limit the scope of the invention, so that description with names of members without all of or a portion of the limitations such as limitations on shapes or amounts are included in the scope of the invention.

For example, in the abovementioned embodiments, the front end portion 321 of the belt 32 is biased by the compression coil spring 33, and the rear end portion 322 of the belt 32 is biased by the tension coil spring 34. However, biasing directions of the first and second biasing units, and concrete arrangements are not limited thereto, but can be appropriately modified.

The invention claimed is:

1. A chain saw braking system for a chain saw having a main body in which there is provided an engine and a chain provided with saw blades, the engine rotating the chain around a guide member provided in the main body by engine drive, wherein the chain saw braking system stops a movement of the chain and comprises:

a drum provided on a rotary shaft of a sprocket for transferring a driving force of the engine to the chain, the drum being rotated together with the sprocket;

a belt that is wound around the drum and has first and second ends which are drawn in opposite directions to each other;

first and second biasing units that bias the first and second ends of the belt in the opposite directions to tighten the drum;

an engagement member that engages the belt with the main body to counteract a biasing force of the first biasing unit; and a restricting unit that restricts, within a given area, the second end of the belt from being moved following a movement of the first end of the belt when the first end is moved by the biasing force of the first biasing unit; and a movement transmitting member that moves the second end of the belt in accordance with a movement of a throttle lever for controlling an output of the engine;

wherein the restricting unit is separated from the movement transmitting member.

2. The chain saw braking system according to claim 1, wherein:

the belt has an attachment portion to which the second biasing unit is attached, the attachment portion has an elongate hole extending in a longitudinal direction of the belt, and the restricting unit is a protrusion to be inserted through the elongate hole.

3. The chain saw braking system according to claim 1, wherein:

the second biasing unit is a coil spring, one end of the coil spring is attached to the second end of the belt and the other end of the coil spring is attached to an internal thread member furnished with internal threads, an external thread member which is fixed to the main body and furnished with external threads is threadedly engaged with the internal thread member, and a rotation of the external thread member allows the internal thread member to be reciprocatively moved in a biasing direction of the coil spring.

4. The chain saw braking system according to claim 1, wherein:

the main body comprises the throttle lever and a stopper engaging with an edge surface of the second end of the belt while the throttle lever is pivoted in a direction against a biasing force of the second biasing unit.

5. A chain saw comprising the chainsaw braking system according to claim 1.

* * * * *